US011589143B2

(12) United States Patent
Yang et al.

(10) Patent No.: US 11,589,143 B2
(45) Date of Patent: Feb. 21, 2023

(54) SPEAKER BOX

(71) Applicant: AAC Microtech (Changzhou) Co., Ltd., Changzhou (CN)

(72) Inventors: Huhu Yang, Shenzhen (CN); Xianjie Dong, Shenzhen (CN); Long Zhang, Shenzhen (CN); Xuefeng Zhang, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/560,186

(22) Filed: Dec. 22, 2021

(65) Prior Publication Data

US 2023/0007372 A1 Jan. 5, 2023

(30) Foreign Application Priority Data

Jun. 30, 2021 (CN) ..... 202121483184.3

(51) Int. Cl.
*H04R 1/02* (2006.01)

(52) U.S. Cl.
CPC ..... *H04R 1/021* (2013.01); *H04R 1/025* (2013.01); *H04R 2400/11* (2013.01); *H04R 2499/11* (2013.01)

(58) Field of Classification Search
CPC .... H04R 1/021; H04R 1/025; H04R 2400/11; H04R 2499/11
USPC ..... 381/334
See application file for complete search history.

(56) References Cited

U.S. PATENT DOCUMENTS

| | | | | |
|---|---|---|---|---|
| 10,225,645 | B1 * | 3/2019 | Lv | H04R 1/021 |
| 10,674,242 | B2 * | 6/2020 | Niu | H04R 1/2873 |
| 10,993,021 | B2 * | 4/2021 | Song | H04R 1/021 |
| 11,237,602 | B2 * | 2/2022 | Yoon | G06F 1/1626 |
| 11,425,491 | B2 * | 8/2022 | Su | H04R 1/028 |
| 2013/0223655 | A1 * | 8/2013 | Lee | H04R 1/34 381/189 |

* cited by examiner

*Primary Examiner* — Sean H Nguyen
(74) *Attorney, Agent, or Firm* — W&G Law Group

(57) ABSTRACT

Provided is a speaker box, including a housing having a receiving space and a speaker unit received therein. The housing extends into the receiving space to form a support wall. The speaker unit is supported by and fixed to the support wall. The housing has a sound output hole. The speaker unit includes a frame, a vibration system and magnetic circuit unit fixed to the frame, and a front cover covering the frame. The front cover is supported by and fixed to the support wall. The front cover includes a main body portion located above the vibration system, a side edge portion and a fixed portion covering the frame. The fixed portion is supported by and fixed to the support wall. The front cover has a through hole running through both the main body portion and the side edge portion. The speaker box has excellent sound quality.

8 Claims, 3 Drawing Sheets

SPEAKER BOX

TECHNICAL FIELD

The present disclosure relates to the field of electroacoustic conversion technologies, and in particular, to a speaker box applied to portable electronic products.

BACKGROUND

In the related art, a speaker box includes a housing having a receiving space and a speaker unit received in the receiving space. The speaker unit includes a frame, a vibration system and a magnetic circuit unit that are fixed to the frame, and a front cover covering the frame. The front cover is provided with a through hole directly opposite to the vibration system and configured to output sound above the speaker unit.

However, due to the limitation of an overall size of the speaker box, a distance between the front cover and the housing is too small after the speaker unit is loaded into the housing, resulting in a narrow sound output channel above the speaker unit, which is easy to produce piano sound and leads to poor sound quality of the speaker box.

Therefore, there is a need to provide a new sounding device to solve the above technical problem.

SUMMARY

An objective of the present disclosure is to provide a speaker box with excellent sound quality to overcome the above technical problem.

In order to achieve the above objective, the present disclosure provides a speaker box, including a housing having a receiving space and a speaker unit received in the receiving space. The housing extends into the receiving space to form a support wall. The speaker unit is supported by and fixed to the support wall. The housing is provided with a sound output hole outputting sound produced by the speaker unit. The speaker unit includes a frame, a vibration system and a magnetic circuit unit that are fixed to the frame, and a front cover covering the frame. The front cover is supported by and fixed to the support wall. The front cover includes a main body portion located above the vibration system, a side edge portion bending and extending from the main body portion toward the vibration system, and a fixed portion bending and extending from the side edge portion to a direction away from the main body portion and covering the frame. The fixed portion is supported by and fixed to the support wall. The front cover is provided with a through hole running therethrough, and the through hole runs through both the main body portion and the side edge portion.

As an improvement, the through hole extends to an inner periphery of the fixed portion.

As an improvement, at least two through holes are provided, and the at least two through holes are arranged in an array.

As an improvement, four through holes are provided, and the four through holes are arranged in a 2×2 array.

As an improvement, the front cover is provided with the through hole at least on a side edge portion close to the sound output hole.

As an improvement, the speaker unit further includes damping mesh attached to the front cover, and the damping mesh completely covers the through hole.

As an improvement, the front cover further includes an extension portion bending and extending from an outer periphery of the fixed portion to a direction away from the main body portion. The extension portion is arranged on a peripheral of the speaker unit and is fixedly connected to the magnetic circuit unit.

As an improvement, the front cover is a metal front cover.

Compared with the related art, in the speaker box according to the present disclosure, the front cover of the speaker unit includes a main body portion located above the vibration system, a side edge portion bending and extending from the main body portion toward the vibration system and a fixed portion bending and extending from the side edge portion to a direction away from the main body portion and covering the frame, the front cover is provided with a through hole running therethrough, and the through hole runs through both the main body portion and the side edge portion. In the above structure, since the through hole runs through the main body portion and the side edge portion at the same time, sound produced by the speaker unit may be outputted from the main body portion and the side edge portion, which, in the case of the limitation to the overall size of the speaker box, improves a sound output manner, makes the sound output channel more smooth, prevents piano sound, and brings excellent good quality of the speaker box.

BRIEF DESCRIPTION OF DRAWINGS

In order to more clearly illustrate the technical solutions in embodiments of the present disclosure, the accompanying drawings used in the description of the embodiments will be briefly introduced below. It is apparent that, the accompanying drawings in the following description are only some embodiments of the present disclosure, and other drawings can be obtained by those of ordinary skill in the art from the structures shown in the provided drawings without creative efforts.

DESCRIPTION OF EMBODIMENTS

The technical solutions in embodiments of the present disclosure will be described clearly and completely below with reference to the accompanying drawings in the embodiments of the present disclosure. It is appreciated that, the described embodiments are merely some of rather than all of the embodiments of the present disclosure. All other embodiments acquired by those skilled in the art without creative efforts based on the embodiments of the present disclosure shall fall within the protection scope of the present disclosure.

Figure 1:
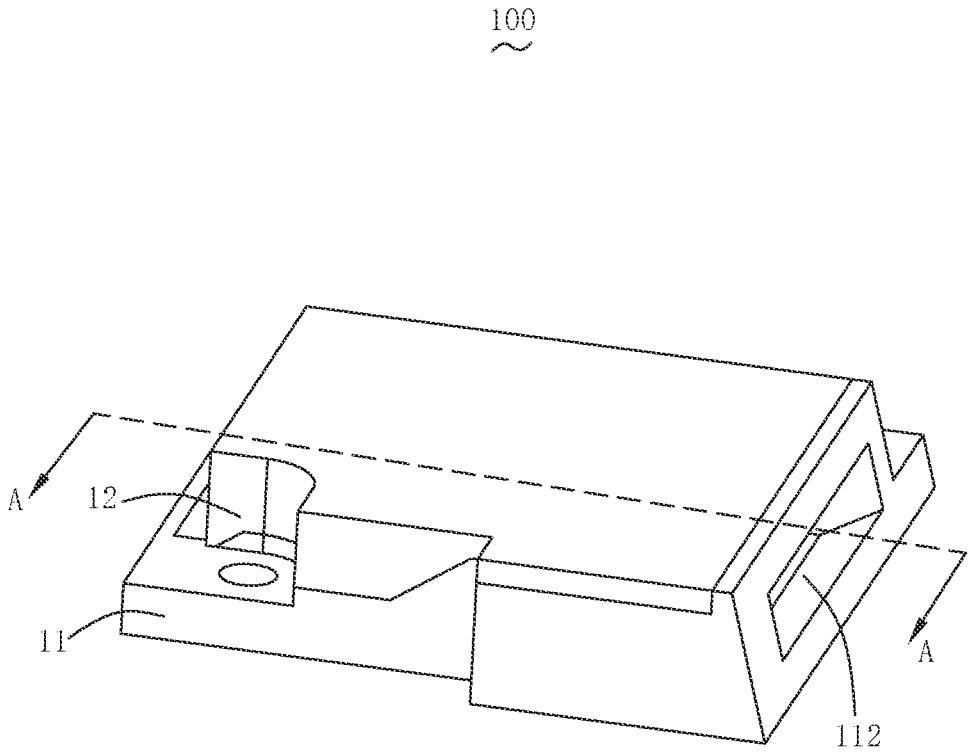
FIG. 1 is a schematic diagram of a perspective structure of a speaker box according to the present disclosure.
Figure 2:
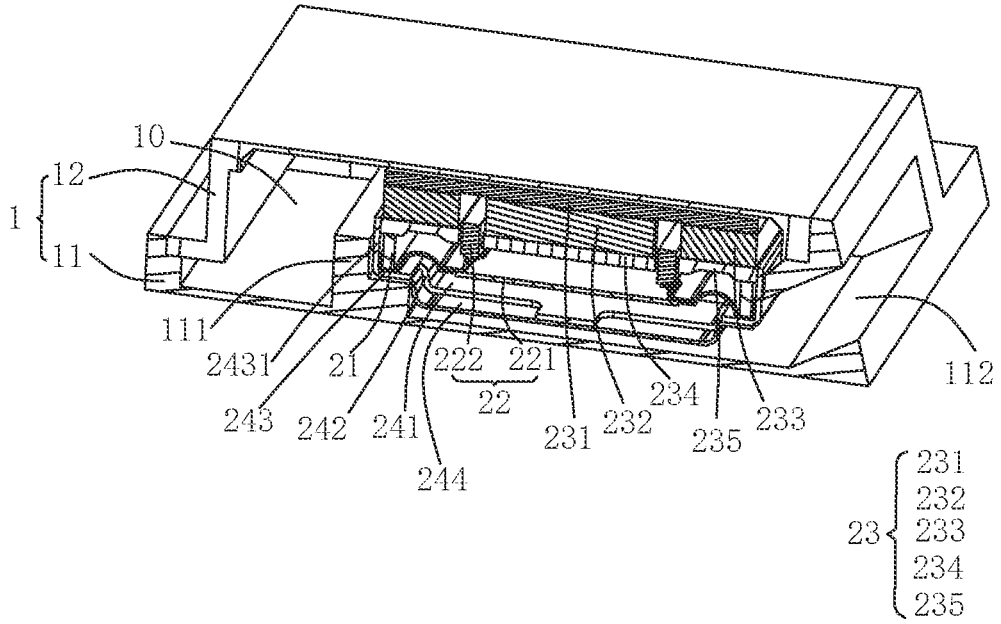
FIG. 2 is a sectional view taken along a line A-A in FIG. 1.
Figure 3:
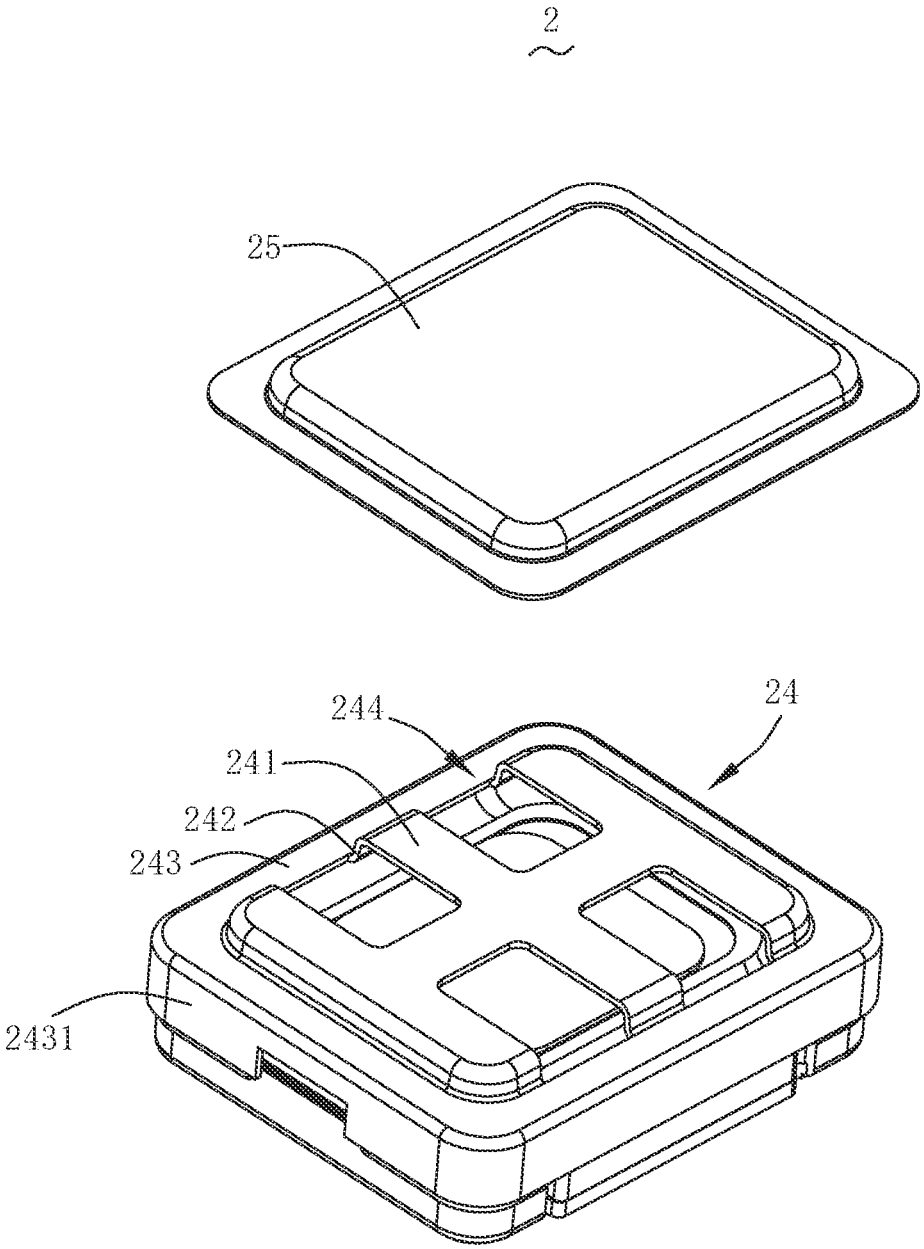
FIG. 3 is a schematic exploded view of a partial structure of a speaker unit in the speaker box according to the present disclosure.

Referring to FIG. 1 to FIG. 3, the present disclosure provides a speaker box 100. The speaker box 100 includes a housing 1 having a receiving space 10 and a speaker unit 2 received in the receiving space 10. The housing 1 extends into the receiving space 10 to form a support wall 111. The speaker unit 2 is supported by and fixed to the support wall 111. The housing 1 is provided with a sound output hole 112 outputting sound produced by the speaker unit 2.

In this embodiment, the housing 1 includes an upper shell 11 and a lower shell 12 covering each other, and the upper shell 11 and the lower shell 12 define the receiving space 10 together. The support wall 111 is formed by extension from the upper shell 11 into the receiving space 10. The sound output hole 112 is formed on the upper shell 11.

The speaker unit 2 includes a frame 21, a vibration system 22 and a magnetic circuit unit 23 that are fixed to the frame 21, and a front cover 24 covering the frame 21. The front cover 24 is supported by and fixed to the support wall 111. The front cover 24 is optionally made of metal. The metal has high strength, can be made thinner, and is also easy to shape.

The front cover 24 includes a main body portion 241 located above the vibration system 22, a side edge portion 242 bending and extending from the main body portion 241 toward the vibration system 22, and a fixed portion 243 bending and extending from the side edge portion 242 to a direction away from the main body portion 241 and covering the frame 21. The fixed portion 243 is supported by and fixed to the support wall 111.

The front cover 24 is provided with a through hole 244 running therethrough. The sound produced by the speaker unit 2 is outputted from the through hole 244. The through hole 244 runs through both the main body portion 241 and the side edge portion 242, so that the sound produced by the speaker unit 2 may be outputted from the main body portion 241 and the side edge portion 242. In an embodiment, the through hole 244 extends to an inner periphery of the fixed portion 243, so as to increase a sound output area of the side edge portion 242.

The speaker unit 2 further includes damping mesh 25 attached to the front cover 24. The damping mesh 25 completely covers the through hole 244. The damping mesh 25 may adjust the damping and may have a function of isolating debris from entering into the interior of the speaker unit 2.

As a further improved manner for sound output, at least two through holes 244 are provided, and the at least two through holes 244 may be arranged in an array. In this embodiment, four through holes 244 are provided, and the four through holes 244 are arranged in a 2×2 array. It is appreciated that, this is intended only to describe a specific embodiment but not to limit the present disclosure. In other optional embodiments, a corresponding number of through holes and a corresponding arrangement manner may be selected according to an actual application environment and specific requirements.

As an optional embodiment, the front cover 24 is provided with the through hole 244 at least on a side edge portion 242 close to the sound output hole 112, which enables the through hole 244 to be better communicated with the sound output hole 112 and further improves smoothness of sound output.

The vibration system 22 includes a diaphragm 221 and a voice coil 222 driving the diaphragm 221 to vibrate and sound. An outer periphery of the diaphragm 221 is sandwiched between the fixed portion 243 and the frame 21.

The magnetic circuit unit 23 includes a lower clamp plate 231, a main magnet 232 arranged at a middle position of the lower clamp plate 231, an auxiliary magnet 233 arranged at an edge position of the lower clamp plate 231 and spaced from the main magnet 232, a main pole plate 234 attached to the main magnet 232, and an auxiliary pole plate 235 attached to the auxiliary magnet 233. The auxiliary pole plate 235 is fixedly connected to the frame 21. The voice coil 222 is inserted between the main magnet 232 and the auxiliary magnet 233.

As an optional embodiment, the front cover 24 further includes an extension portion 2431 bending and extending from an outer periphery of the fixed portion 243 to a direction away from the main body portion 241. The extension portion 2431 is arranged on a peripheral of the speaker unit 2 and is fixedly connected to the magnetic circuit unit 23. In this embodiment, the extension portion 2431 is fixedly connected to the auxiliary pole plate 235, which are optionally fixed by soldering. It is appreciated that, fixed positions of the extension portion 2431 and the magnetic circuit unit 23 may be selected according to an actual application environment and specific requirements, and are not limited to the auxiliary pole plate 235, which, for example, may be fixed to the auxiliary magnet 233 or the lower clamp plate 231.

Compared with the related art, in the speaker box according to the present disclosure, the front cover of the speaker unit includes a main body portion located above the vibration system, a side edge portion bending and extending from the main body portion toward the vibration system, and a fixed portion bending and extending from the side edge portion to a direction away from the main body portion and covering the frame, the front cover is provided with a through hole running therethrough, and the through hole runs through the main body portion and the side edge portion at the same time. In the above structure, since the through hole runs through the main body portion and the side edge portion at the same time, sound produced by the speaker unit may be outputted from the main body portion and the side edge portion, which, in the case of the limitation to the overall size of the speaker box, improves a sound output manner, makes the sound output channel more smooth, prevents piano sound, and brings excellent good quality of the speaker box.

The above are only embodiments of the present disclosure. It should be pointed out that those of ordinary skill in the art may also make improvements without departing from the ideas of the present disclosure, all of which fall within the protection scope of the present disclosure.

What is claimed is:

1. A speaker box, comprising a housing having a receiving space and a speaker unit received in the receiving space, the housing extending into the receiving space to form a support wall, the speaker unit being supported by and fixed to the support wall, the housing being provided with a sound output hole outputting sound produced by the speaker unit, wherein the speaker unit comprises a frame, a vibration system and a magnetic circuit unit that are fixed to the frame, and a front cover covering the frame, the front cover is supported by and fixed to the support wall, the front cover comprises a main body portion located above the vibration system, a side edge portion bending and extending from the main body portion toward the vibration system, and a fixed portion bending and extending from the side edge portion to a direction away from the main body portion and covering the frame, the fixed portion is supported by and fixed to the support wall, the front cover is provided with a through hole running therethrough, and the through hole runs through both the main body portion and the side edge portion.

2. The speaker box as described in claim 1, wherein the through hole extends to an inner periphery of the fixed portion.

3. The speaker box as described in claim 1, wherein at least two through holes are provided, and the at least two through holes are arranged in an array.

4. The speaker box as described in claim 1, wherein four through holes are provided, and the four through holes are arranged in a 2×2 array.

5. The speaker box as described in claim 1, wherein the front cover is provided with the through hole at least on a side edge portion close to the sound output hole.

6. The speaker box as described in claim 1, wherein the speaker unit further comprises a damping mesh attached to the front cover, and the damping mesh completely covers the through hole.

7. The speaker box as described in claim 1, wherein the front cover further comprises an extension portion bending and extending from an outer periphery of the fixed portion to a direction away from the main body portion, and the extension portion is arranged on a peripheral of the speaker unit and is fixedly connected to the magnetic circuit unit.

8. The speaker box as described in claim 1, wherein the front cover is a metal front cover.

* * * * *